US008578641B2

(12) United States Patent
Suciu et al.

(10) Patent No.: US 8,578,641 B2
(45) Date of Patent: Nov. 12, 2013

(54) ILLUMINATED FRONT LOADING FRAME DISPLAY

(75) Inventors: Rebecca C. Suciu, Lynn, MA (US); Thomas P. Burrous, Haverhill, MA (US); Pual P. Ellsworth, Burlington, MA (US); Alan L. Stenfors, Scituate, MA (US); Sidney Rose, Marblehead, MA (US)

(73) Assignee: Rose Displays Ltd, Salem, MA (US)

( * ) Notice: Subject to any disclaimer, the term of this patent is extended or adjusted under 35 U.S.C. 154(b) by 0 days.

(21) Appl. No.: 13/385,573

(22) Filed: Feb. 24, 2012

(65) Prior Publication Data

US 2012/0210622 A1 Aug. 23, 2012

Related U.S. Application Data

(63) Continuation-in-part of application No. 12/660,931, filed on Mar. 18, 2010, now Pat. No. 8,196,325, which is a continuation-in-part of application No. 11/799,001, filed on Apr. 30, 2007, now Pat. No. 7,743,541.

(51) Int. Cl.

| | |
|---|---|
| ***A47G 7/00*** | (2006.01) |
| ***A47G 29/10*** | (2006.01) |
| ***G09F 3/20*** | (2006.01) |
| ***G09F 3/00*** | (2006.01) |

(52) U.S. Cl.

USPC ..... 40/658; 40/361; 40/617; 40/605; 40/710; 40/649; 40/777; 40/792; 40/793; 40/791; 40/790; 40/647; 40/611.11; 40/611.12; 40/611.01; 40/611.02; 248/229.1; 248/316.1; 248/316.7; 248/489

(58) Field of Classification Search

USPC ..... 40/790–793, 647, 611.01, 611.02, 40/611.11, 611.12, 361, 658, 617, 605, 40/710, 649; 248/229.1, 316.1, 316.7, 248/489, 451

See application file for complete search history.

(56) References Cited

U.S. PATENT DOCUMENTS

| | | | | |
|---|---|---|---|---|
| 4,498,255 | A * | 2/1985 | Heard | 40/793 |
| 6,305,112 | B1 * | 10/2001 | Hansen | 40/743 |
| 6,678,982 | B2 * | 1/2004 | Pitcher et al. | 40/793 |

* cited by examiner

*Primary Examiner* — Syed A Islam
(74) *Attorney, Agent, or Firm* — Don Halgren

(57) ABSTRACT

A thin, illuminatable graphic support assembly comprising an elongated base rail having an elongated first edge and an elongated second edge; an elongated cover rail having an elongated planar portion arranged along one edge thereof, and an elongated "J" shaped portion arranged along a second edge thereof, the elongated cover rail pivotable between an open orientation and a closed graphic or panel restraining position; an elongated receiving channel arranged in the elongated second edge of the base rail, with a biasing member arranged therein, and a fixture support first channel and a fixture support second channel on an outer lower side of the base rail, to enable the illuminable graphic support assembly to be selectively secured to a wall.

12 Claims, 8 Drawing Sheets

ILLUMINATED FRONT LOADING FRAME DISPLAY

BACKGROUND OF THE INVENTION

1. Field of the Invention

The present invention comprises an illuminated display arrangement constructed from a set of extruded rails which when assembled provide a readily supported, thin rectangular frame which may be loaded from its front side after it is completely assembled, and is a Continuation-In-Part application of our co-pending U.S. patent application Ser. No. 12/660,931, and a Continuation-In-Part of Ser. No. 11/799,001 each of which are incorporated herein by reference, in its entirety.

2. Prior Art

In the retail industry it is often necessary to display a graphic surface in close proximity to other graphic displays. Further, those graphic displays need to be neat, presentable and readily changeable. Additionally, those display fixtures themselves may need to be a relatively unobtrusive by themselves being minimalist. Such display fixtures could be used in an illuminated format within a securable capture frame of minimum thickness. This would permit such a display fixture or frame next to or within other fixed objects such as walls or fixtures.

It is an object of the present invention, to provide a display fixture arrangement which is minimized in its dimensions so as not to be obtrusive.

It is a further object of the present invention to provide a display fixture arrangement which may be loaded with a graphic from the front.

It is a further object of the present invention to provide a low profile display fixture arrangement with a perimeter portion which, when opened, will not interfere with any other immediately adjacent fixture arrangements.

It is a further object of the present invention to provide a low profile display fixture arrangement that contains a spring mechanism that is fully contained in a minimal, angled relationship with respect to the display piece and its peripheral display biasing cover rail.

It is yet an object to provide a display arrangement of this nature which includes an illuminated backer panel.

It is another object of the present invention to provide an illuminated frame arrangement of minimal thickness which is readily and safely securable to a wall or other vertical support.

BRIEF SUMMARY OF THE INVENTION

The present invention comprises a graphic display fixture which in its most preferred embodiment would comprise a full perimeter frame for a graphic display. Each side portion of the frame is comprised of an elongated extruded cover rail and an elongated extruded base rail. The cover rail has an elongated "J" shaped edge which pivotably mates within an elongated, oblique channel on one long edge of the base rail.

The cover rail also comprises an elongated planar side portion which defines one elongated edge thereof, and it appears "tangentially" to its elongated generally "J" shaped hinge portion, which defines the other elongated edge or side thereof. The hinge portion of the cover rail includes an elongated cover-rail toe consisting of the distalmost portion of the hinge of the cover rail. An elongated pivot arm extends from a segment of the cover rail toe at a slightly obtuse angle with respect thereto. An elongated slot is formed between the elongated pivot arm and the "J" shaped hinge portion of the cover rail. An elongated shoulder extends along the length of the elongated cover rail at a portion of the underside of the elongated plane portion immediately adjacent to the "J" shaped hinge portion.

The elongated base rail comprises an elongated planar portion having an "T" shaped corner bracket-capture and illuminated panel support flange integral to and generally adjacent a first elongated edge thereof. The capture flange partially defines an elongated bracket channel. The elongated base rail has an elongated upstanding flange extending along a second elongated edge thereof. The surface of the flange is in co-planar alignment with the planar side portion of the cover rail when the cover rail is in its full open orientation. A wall extends perpendicularly away from the planar portion of the base rail at a location intermediate the elongated flange on the second elongated end of the base rail and the T-shaped corner bracket capture and illuminated panel support flange thereon.

The "T" shaped corner bracket-capture and illuminated panel support flange has an elongated mirror-image "T" shape flange. An elongated fixture-support first channel is disposed therebetween. An elongated fixture-support second channel is arranged between an "L" shaped lower edge of the upstanding flange and the elongated mirror-image "T" shape flange.

An electrically empowered illuminated panel is disposed upon the elongated flange, and is in abuttable juxtaposition with the perpendicular wall of the base rail. Electrical empowerment means for the illumination panel, such as an electrical power cable, or a battery pack, are the preferred power means for the illuminated panel.

The perpendicular wall and the elongated flange on the second edge of the base rail, and an oblique spring support base, defines the open, elongated, oblique channel therebetween. The spring support base lies in a plane which is oblique to the plane on the mirror image "T" shaped flange of the base rail. An elongated base rail support flange or lip, for peripherally supporting a graphic or panel, extends off of the perpendicular wall and is also arranged parallel to the plane of the base rail.

An illuminated panel receiving channel is thus arranged between the elongated lip and the elongated illuminated panel support flange on each elongated base rail defining the four-sided display fixture.

A somewhat "J" shaped cover engagement upper flange extends off of the other side of the angled wall of elongated base rail, in generally co-planar alignment with, and from which the base rail lip extends.

In the assembly of one side of a graphic display fixture, such as a rectilinear frame, the generally "J" shaped hinge portion of the elongated cover rail is slid into the elongated, oblique channel which extends along the second edge of the elongated base rail. The upper "J" shaped cover engagement flange is shaped so as to slide into and be received in the elongated slot between the pivot arm of the cover rail and the "J" shaped portion of that cover rail, to define an elongated pivot axis relationship therewithin.

An elongated wave shaped spring is inserted between the outer edge of the cover rail toe and the oblique inner surface spring support base of the elongated, oblique, open channel of the base rail. The elongated wave spring, which itself is thus widthwise enclosed in an oblique orientation with respect to the plane "P", supported "beneath" the graphic or panel, and comprises a thin alternating form of waves having an alternating series of crests and troughs. A ridge is arranged transversely across the midpoint on the upper edge of the crest along the length of the elongated wave spring. The outer edge of the cover rail toe is in frictional biased engagement with those series of ridges spaced along the length of the wavy spring.

The illuminated panel is arranged to be substituted for the backer board of our '931 parent application, which illuminated panel may be placed within the assembly of the cover rail and the base rail wherein the illuminated panel is placed adjacent the corner bracket capture flange and beneath the base rail lip parallel thereto. A display graphic or panel is intended to be arranged on the outermost surface of the base rail lip. Pivoted movement of the elongated planar side portion of the cover rail, from an orientation perpendicular to the base rail and into a restraining, preferably slightly spaced apart relationship, with (and depending upon the thickness of) the display piece panel on the base rail lip, establishing the holding of that display piece panel within the fixture device of the frame assembly. A further space may be provided between the panel/graphic and the illuminated panel, so as to provide a limited flexibility to the display panel when it is necessary to get easy access to the inner edge of the cover rail, for replacement of that display graphic/panel.

Four of these assemblies of cover rails and base rails which each supports a common illuminated panel, may be joined together at the corners by a corner bracket as shown our co-pending parent '931 application, and incorporated herein by reference in its entirety.

The invention thus comprises a thin, illuminatable graphic support assembly comprising; an elongated base rail having an elongated first edge and an elongated second edge; an elongated cover rail having an elongated planar portion arranged along one edge thereof, and an elongated "J" shaped portion arranged along a second edge thereof, the elongated cover rail pivotable between an open orientation and a closed graphic or panel restraining position; an elongated receiving channel arranged in the elongated second edge of the base rail, with a biasing member arranged therein, the elongated "J" shaped portion of the cover rail hingedly arranged also with the elongated receiving channel, to permit the cover rail to be pivoted about its "J" shaped portion which is tangential to the "J" shaped portion of the cover rail and the outer edge of the receiving channel in the base rail, so as to enable the graphic support assembly to retain a display panel between the cover rail and the base rail; and a fixture support first channel and a fixture support second channel on an outer lower side of the base rail, to enable the illuminable graphic support assembly to be selectively secured to a wall. The fixture support first channel consists of a generally "U" shaped slot directed inwardly from the second edge of the base rail. The second channel consists of a generally "T" shaped slot. The fixture support first channel and the fixture support second channel share a common web member therebetween. The elongated base rail has an elongated flange for support of the illuminatable panel thereon. The fixture support first channel and the fixture support second channel are parallel to one another around the entire support assembly. The fixture support first channel is partially defined by an elongated "L" shaped corner member. The fixture support second channel is defined by a pair of parallel flanges and an elongated web member, which web member is common to both channels.

The invention also includes an elongated illuminable graphic support assembly, for supporting a planar graphic in a crowded space, comprising: an elongated base rail having an elongated support flange for supporting an edge of a graphic, the elongated base rail having an upper "J" shaped edge in planar alignment with the elongated support flange, and an elongated support flange for supporting an illuminable panel in close spaced apart juxtaposition with the planar graphic, and wherein the base rail has at least two differently directed support receiving channels. The two differently directed support receiving channels have a common base rail web disposed therebetween.

BRIEF DESCRIPTION OF THE DRAWINGS

The objects and advantages of the present invention will become more apparent when viewed in conjunction with the following drawings in which.

DETAILED DESCRIPTION OF THE INVENTION

Figure 1:
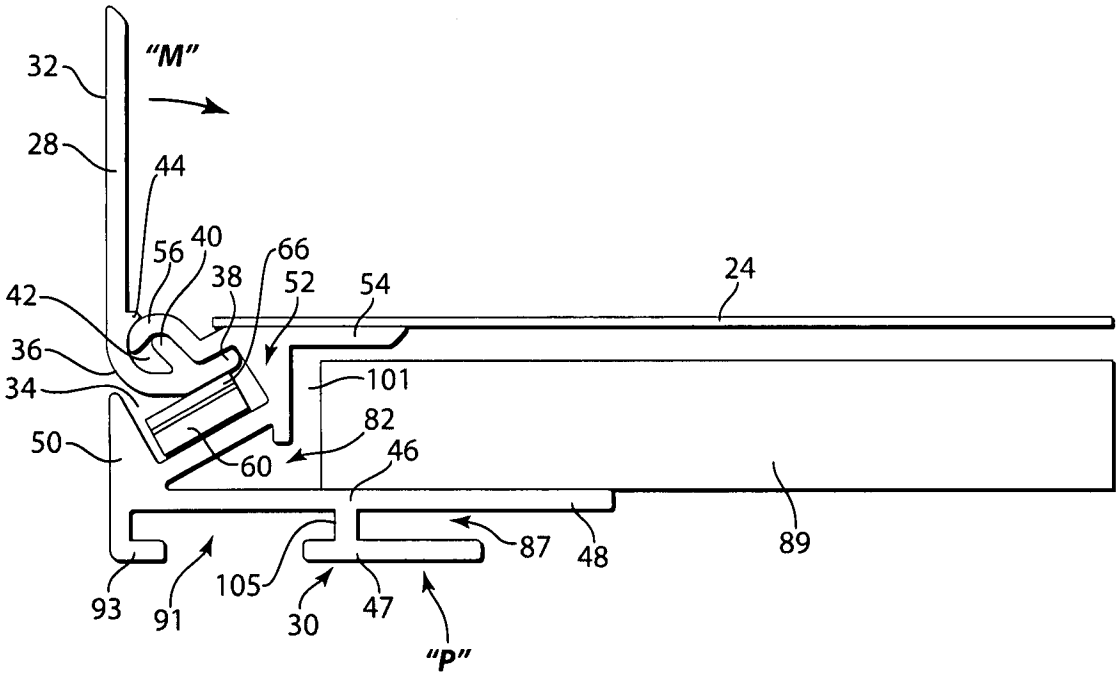
FIG. 1 is a side elevation view of an elongated cover rail, an elongated base rail and an elongated wave spring assembled together with an illuminatable panel spaced beneath a display panel with the elongated cover rail fully opened in its graphic-receiving orientation.
Figure 2:
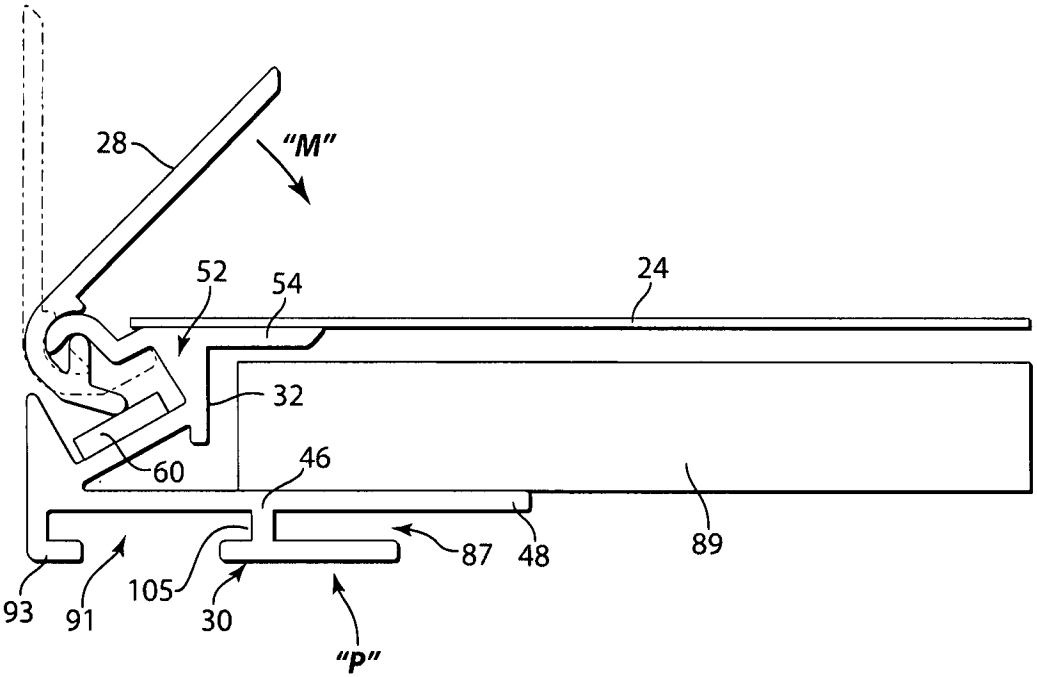
FIG. 2 is a side elevation view similar to FIG. 1, showing the elongated cover rail pivoted partially towards the elongated rail lip on the base rail.
Figure 3:
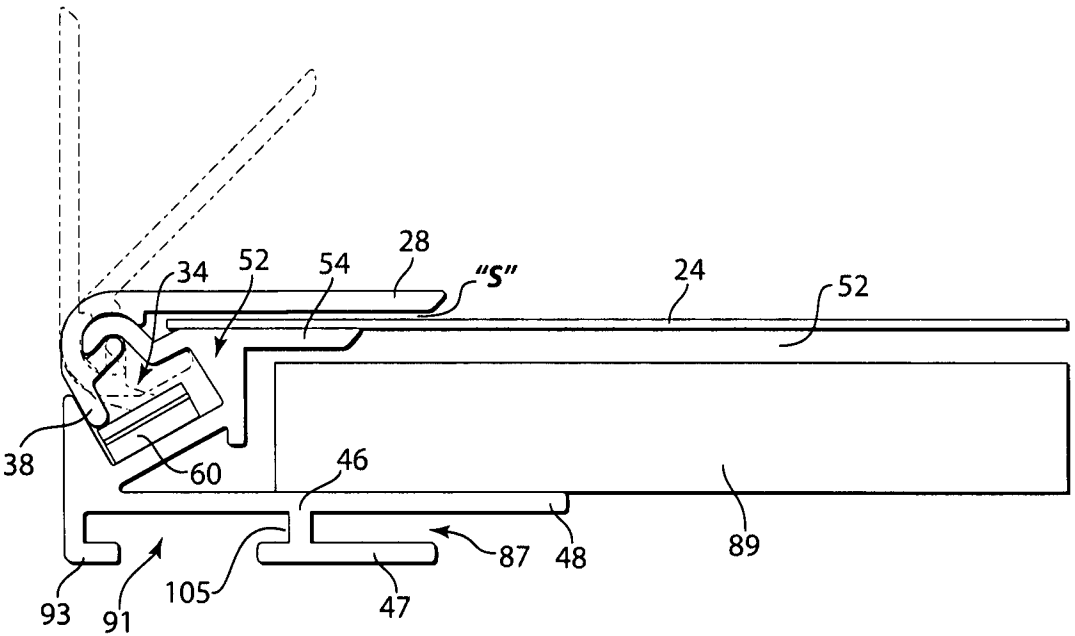
FIG. 3 is a side elevation view similar to FIG. 2 showing the elongated cover rail pivoted down into graphic-display-panel-engaging relationship relative to the base rail lip and the illuminatable panel.
Figure 6:
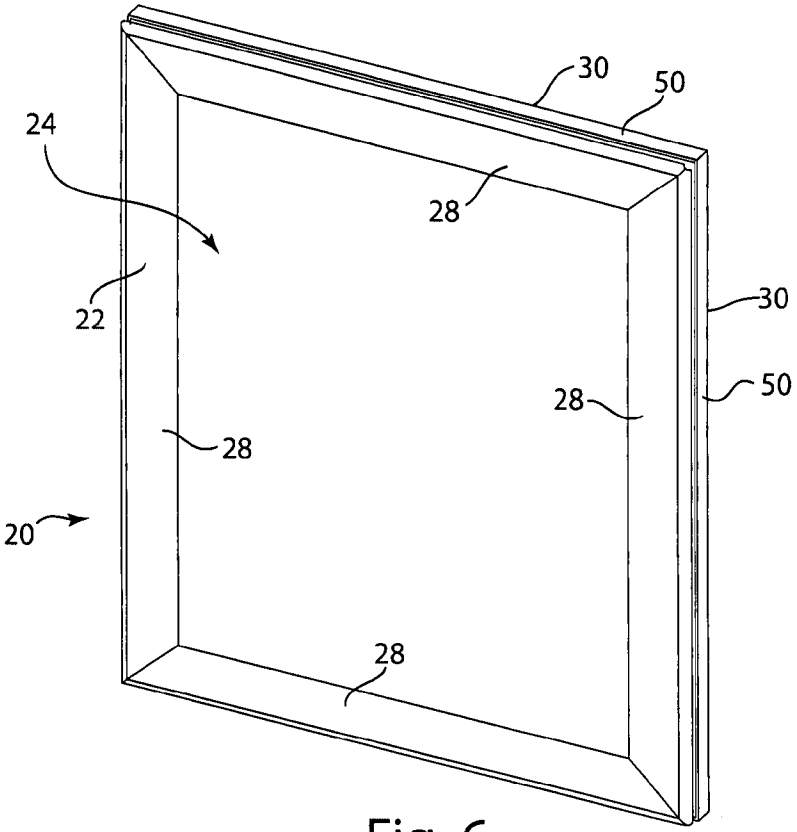
FIG. 6 is a perspective view of a frame assembly enclosing a display panel.

The present invention comprises a graphic display fixture 20 which in its most preferred embodiment would comprise a full perimeter frame 22 for a graphic display 24, as shown in FIG. 6. Each side portion of the frame 22 is comprised of an elongated extruded cover rail 28 and an elongated extruded base rail 30, which is preferably of equal length to the cover rail 28, as represented in FIGS. 1-3. The cover rail 28 has an elongated "J" shaped edge 36 which pivotably mates within an elongated, oblique channel 34 on one long edge of the base rail 30, as is represented in end views, by FIGS. 1, 2 and 3.

Figure 5:
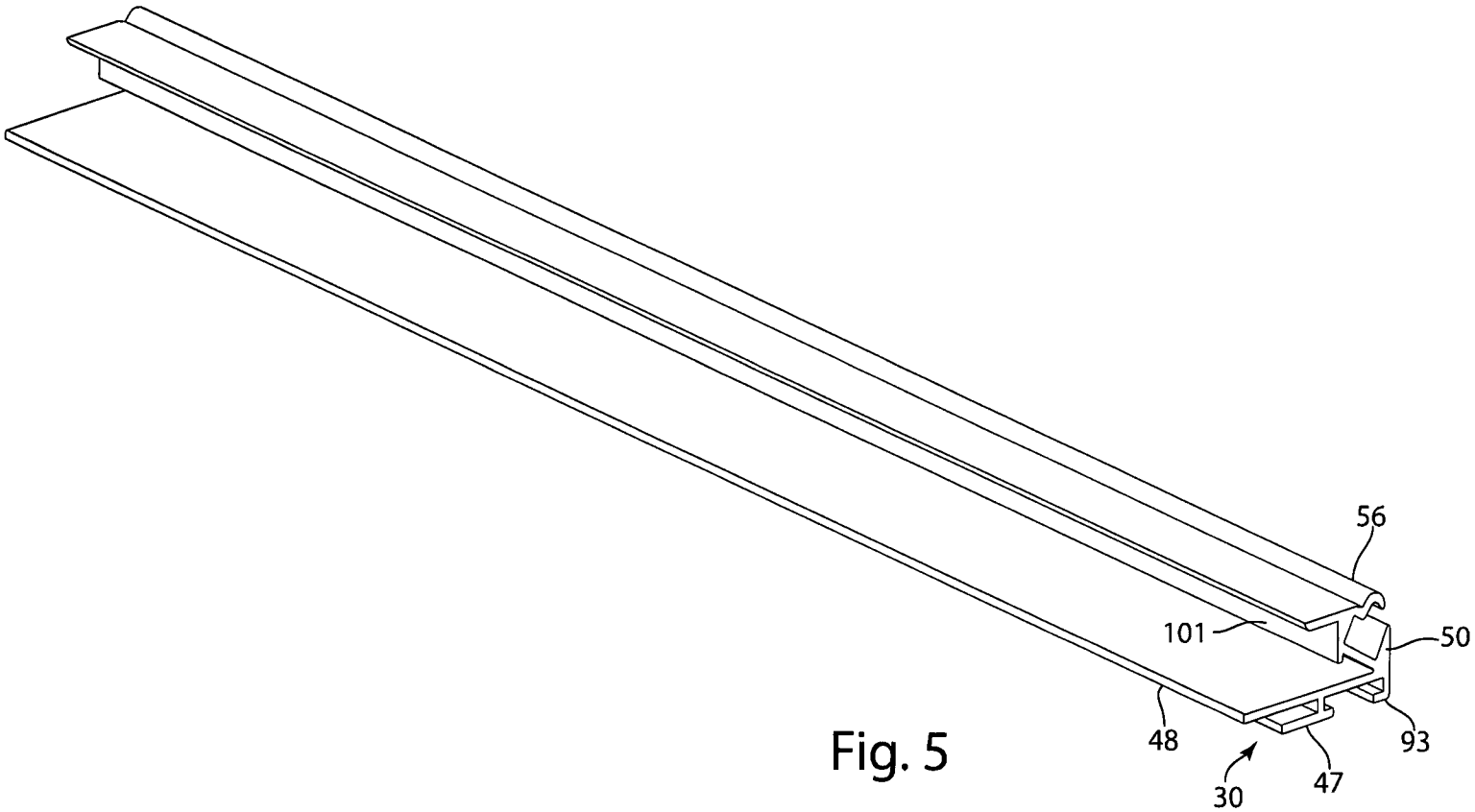
FIG. 5 is a perspective view of the elongated base rail shown in FIG. 4.

The cover rail 28 also comprises an elongated planar side portion 32 which defines one elongated edge thereof, and it appears "tangentially" to its elongated generally "J" shaped hinge portion 36, which defines the other elongated edge or side thereof. The hinge portion 36 of the cover rail 28 includes an elongated cover-rail toe 38 consisting of the distalmost portion of the hinge of the cover rail 28. An elongated pivot arm 40 extends from a segment of the cover rail toe 38 at a slightly obtuse angle "A" with respect thereto, as may be seen in (FIG. 5) of our co-pending '931 parent application. An elongated slot 42 is formed between the elongated pivot arm 40 and the "J" shaped hinge portion 36 of the cover rail 28. An elongated shoulder 44 extends along the length of the elongated cover rail 28 at a portion of the underside of the elongated plane portion 32 immediately adjacent to the "J" shaped hinge portion 36.

Figure 4:
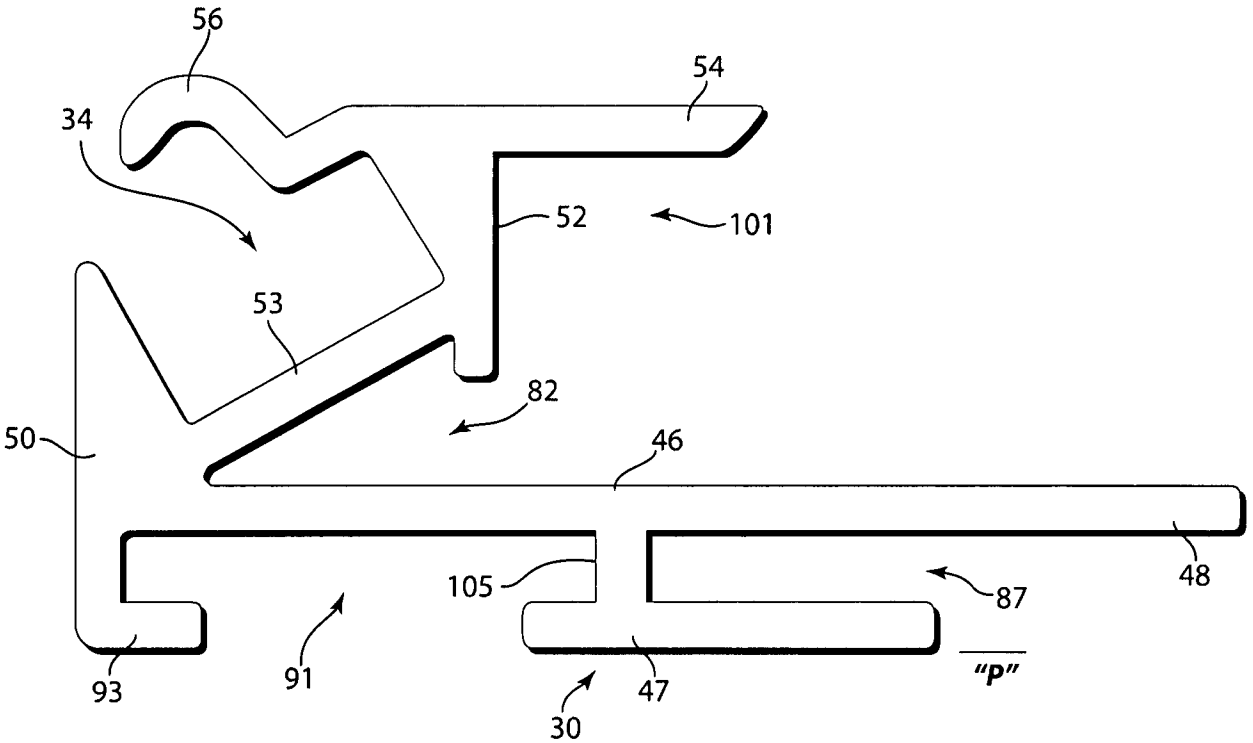
FIG. 4 is an end view of the elongated base rail.

The elongated base rail 30 comprises an elongated planar portion having an "T" shaped corner bracket-capture and illuminated panel support flange 46 integral to and generally adjacent a first elongated edge 48 thereof, the capture flange 46 partially defining an elongated bracket channel 87, as shown in FIGS. 1-4. The elongated base rail 30 has an elongated upstanding flange 50 extending along a second elongated edge thereof. The surface 51 of the flange 50, shown in FIG. 4, is in co-planar alignment with the planar side portion 32 of the cover rail 28, when the cover rail 28 is in its full open orientation, as represented in FIG. 1. A wall 52 extends perpendicularly away from the planar portion of the base rail 30 at a location intermediate the elongated flange 50 on the second elongated end of the base rail 30 and the T-shaped corner bracket capture and illuminated panel support flange 46 thereon, as best represented in FIG. 4.

The "T" shaped corner bracket-capture and illuminated panel support flange 46 has an elongated generally mirror-image "T" shaped flange 47 juxtaposed with respect thereto. An elongated generally "U" shaped in cross-section, fixture-support first channel 87, directed inwardly, with its open portion directed away from the "L" shaped lower edge 93 on the corner of the base rail 30, as represented in FIGS. 1-4.

An elongated "T" shaped, fixture-support second channel 91 is arranged between the "L" shaped lower edge 93 of the upstanding flange 50 and the elongated mirror-image "T" shape flange 47, as represented in FIGS. 1-4. The fixture support first channel 87 and the fixture support second channel 91 share a common web 105 between one another, as represented in FIGS. 1-4, the web 105 defining a common wall between the two support channels 87 and 91. The two, parallel, adjacent, fixture support channels 87 and 91 permits the user a "support option" for supporting the relatively heavy illuminated fixture assembly 20 on a wall, such as will be presented hereinbelow and in FIGS. 9 and 10. Those parallel channels 87 and 91 are also part of and open to the back side of each of the base rails 30 which comprise the four sided full perimeter frame 22.

An electrically empowered illuminated panel 89 is disposed upon the elongated flange 46 and the elongated lip edge 48, and is in abuttable juxtaposition with the perpendicular wall 52 of each rail 30. Electrical empowerment means for the illumination panel 89, such as an electrical power cable(s), not shown for ease of viewing the invention, may unobtrusively tucked in and extend in and along the space saving, perimeter co-extensive, elongated power channel 82, to a power source, not shown, for clarity of the figures.

The perpendicular wall 52 and the elongated flange 50 on the second edge of the base rail 30, and an oblique spring support base 53, best represented in FIG. 4, defines the open, elongated, oblique channel 34 therebetween. The spring support base 53 lies in a plane which is oblique to the plane "P" on the mirror image "T" shaped flange 47 of the base rail 30, as shown in FIG. 1. An elongated base rail support flange or lip 54, for peripherally supporting a graphic or panel 24, as shown in FIGS. 1, 2 and 3, extends off of the perpendicular wall 52, and is also arranged parallel to the plane "P" of the base rail 30, as represented in FIGS. 1 and 4.

An illuminated panel receiving channel 101 is thus arranged between the elongated lip 54 and the elongated illuminated panel support flange 48, on each elongated base rail 30, as shown in FIG. 4. Four such rails 30 defining the four-sided display fixture 22.

A somewhat "J" shaped cover engagement upper flange 56 extends off of the other side of the angled wall 52 of elongated base rail 30, in generally co-planar alignment with, and from which the base rail lip 54 extends, as may be seen in FIGS. 1-4.

In the assembly of one side of a graphic display fixture 20, such as a rectilinear frame 22, as is shown in FIG. 6, the generally "J" shaped hinge portion 36 of the elongated cover rail 28 is slid into the elongated, oblique channel 34 which extends along the second edge of the elongated base rail 30. The upper "J" shaped cover engagement flange 56 is shaped so as to slide into and be received in the elongated slot 42 between the pivot arm 40 of the cover rail 28 and the "J" shaped portion 36 of that cover rail 28, as may be seen in FIGS. 1, 2 and 3 to define an elongated pivot axis relationship therewithin.

Figure 7:
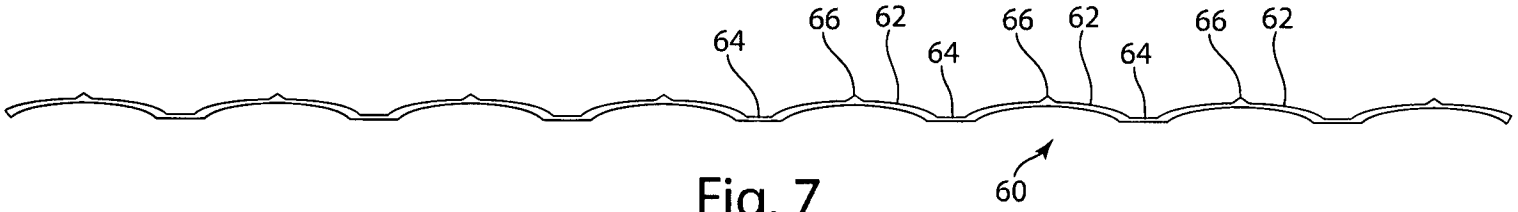
FIG. 7 is a side elevation view of an elongated wave spring utilized with the present invention.
Figure 8:
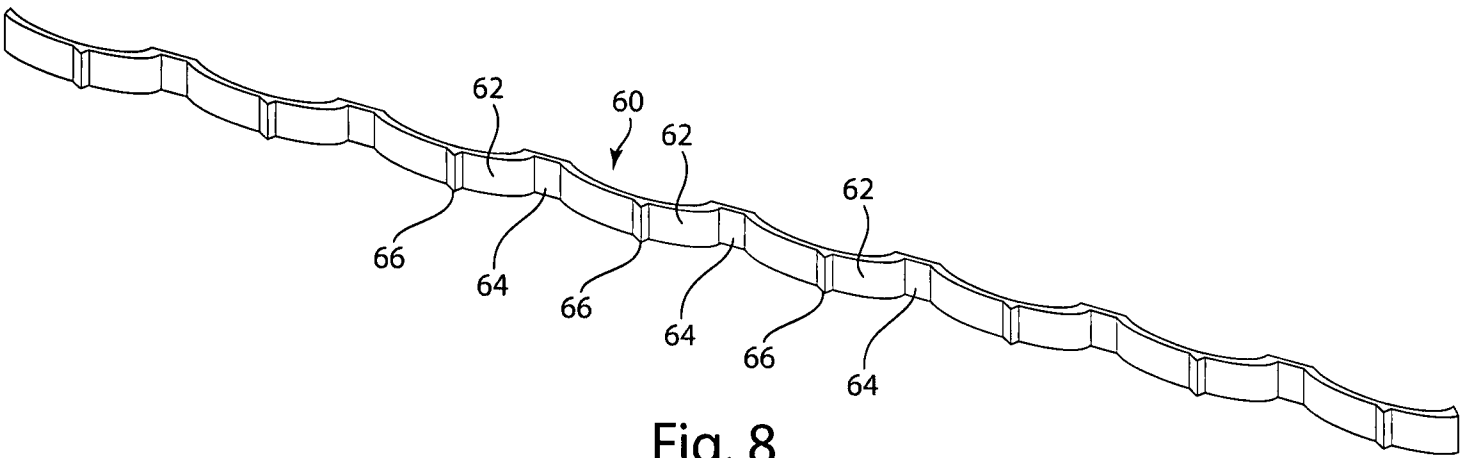
FIG. 8 is a perspective view of the elongated wave spring shown in FIG. 7.

An elongated wave shaped spring 60, as represented in FIGS. 6 and 7, is inserted between the outer edge of the cover rail toe 38 and the oblique inner surface spring support base 53 of the elongated, oblique, open channel 34 of the base rail 30, as represented in FIGS. 1, 2 and 3. The elongated wave spring 60, which itself is thus widthwise enclosed in an oblique orientation with respect to the plane "P", supported "beneath" the graphic or panel 24, and comprises a thin alternating form of waves having an alternating series of crests 62 and troughs 64. A ridge 66 is arranged transversely across the midpoint on the upper edge of the crest 62 along the length of the elongated wave spring 60, as may be seen in FIGS. 6 and 7. The outer edge of the cover rail toe 38 is in frictional biased engagement with those series of ridges 66 spaced along the length of the wavy spring 60, as is shown in FIGS. 1, 2 and 3.

The illuminated panel 89 is arranged to preferably be substituted for the backer board 68 which is represented in our '931 parent application, which illuminated panel 89 may be placed within the assembly of the cover rail 28 and the base rail 30, wherein the illuminated panel 89 is placed adjacent the corner bracket capture flange 46 and beneath the base rail lip 54 parallel thereto, as shown in FIGS. 1, 2 and 3. A display graphic or panel 24 is intended to be arranged on the outermost surface of the base rail lip 54. Pivoted movement, (as indicated by the arrow "M" in FIGS. 1 and 2), of the elongated planar side portion 32 of the cover rail 28, from an orientation perpendicular to the base rail 30, as represented in FIG. 1, moving through the orientation shown in FIG. 2, and into a restraining, preferably slightly spaced apart (as defined by thin space "S" represented in FIG. 3) relationship, with (and depending upon the thickness of) the display piece panel 24 on the base rail lip 54, establishing the holding of that display piece panel 24 within the fixture device 20 of the frame assembly 22. A further planar space S2 is also shown in an edge view, in FIG. 3, may be provided between the panel/graphic 24 and a illuminated panel 89, so as to provide a limited flexibility to the panel 24 when it is necessary to get easy access to the inner edge of the cover rail 28, for replacement of that graphic/panel 24.

Four of these assemblies 20 of cover rails 28 and base rails 30 which each supports a side of the common illuminated panel 89, may be joined together at their ends (frame 22 corners) typically by an "L" shaped corner bracket connectively inserted into the respective ends of transversely adjacent second channels 91, as represented in our co-pending parent '931 application, and incorporated herein by reference in its entirety.

Figure 9:
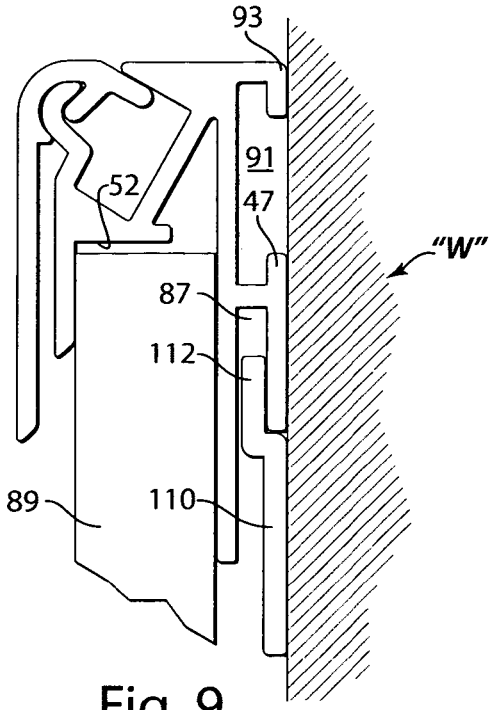
FIG. 9 is a sectional view representing a base rail secured to a wall, by one preferred embodiment.
Figure 10:
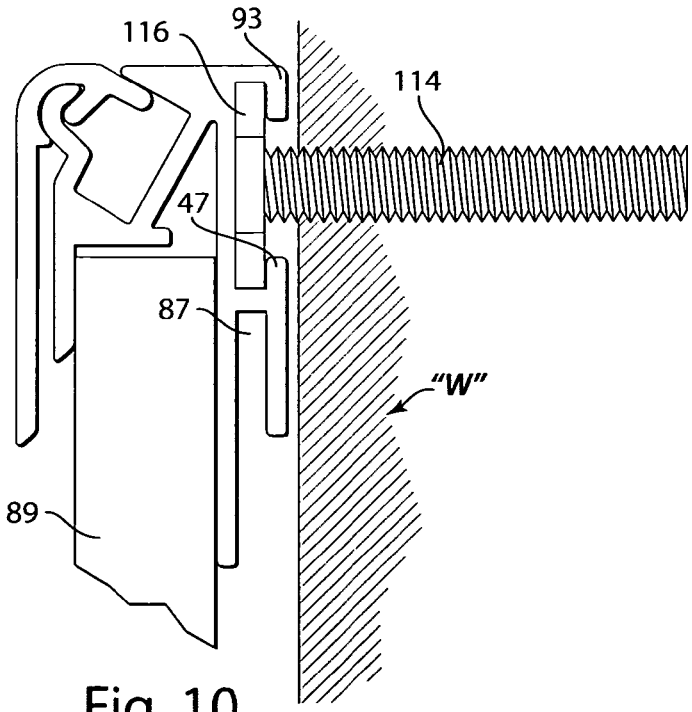
FIG. 10 is a sectional view similar to FIG. 9, representing a base rail secured to a wall by a further securement arrangement.

FIG. 9 shows a fixture support 110 having a "stepped" elongated upstanding distal edge 112 which is slidingly received in the elongated, (shown "downwardly directed" here) fixture-support-receiving "hang bracket" first channel 87. The fixture support 110 is secured to a wall "W" with its stepped edge 112 providing the retention for the fixture 20 and its somewhat heavy illumination panel 89. FIG. 10 shows a similar support fixture, for example, here a threaded bolt 114, with a head 116, which head 116 is slidably received into the elongated fixture-support-receiving second channel 91 for supporting the fixture 20 on a wall "W". The head 116 of the bolt 114 may be slidably inserted into the second channel 91 prior to the frame 22 being fully assembled. In a further embodiment, the elongated second channel 91 may have an enlarged opening (not shown for clarity) near one or both ends thereof, to permit the head 116 of the bolt 114 to be inserted therein, and slid towards a narrower portion of the second channel 91, for proper balanced support of the frame assembly 22.

Thus what has been shown is an illuminable frame assembly which permits the loading of a graphic display from a front approach thereto, the frame assembly including a base rail for supporting the illuminatable panel, the base rail having multiple channels on its inner wall facing surface to permit multiple choices for engaging a support member to that frame assembly. The frame assembly of the present invention also allows the frame to slidingly receive mounting hardware such as the head of a bolt or the like during (or after) the assembly of the frame into a receiving channel which channel is also open to the rear or backside of the frame assembly.

The invention claimed is:

1. An illuminable graphic support assembly comprising;

an elongated base rail having an elongated first edge and an elongated second edge;

an elongated cover rail having an elongated planar portion arranged along one edge thereof, and an elongated "J" shaped portion arranged along a second edge thereof, the elongated cover rail pivotable between an open orientation and a closed graphic or panel restraining position;

an elongated receiving channel arranged in the elongated second edge of the base rail, with a wavy elongated biasing member having alternating crests and troughs arranged therealong, the wavy, elongated biasing member having a series of spaced apart ridges arranged transversely across the midpoint of the crests along the length thereof, the elongated "J" shaped portion of the cover rail hingedly arranged within the elongated receiving channel with a toe portion thereof in frictional biased engagement with the spaced apart ridges of the elongated biasing member, to permit the cover rail to be biasedly pivoted about its "J" shaped portion which is tangential to the "J" shaped portion of the cover rail and the outer edge of the receiving channel in the base rail, so as to enable the graphic support assembly to biasedly retain a display panel between the cover rail and the base rail; and a downwardly directed fixture support first channel and a rearwardly open fixture support second channel on an outer lower side of the base rail, to enable the illuminable graphic support assembly to be selectively secured to a wall by support members from different directions.

2. The illuminable graphic support assembly as recited in claim 1, wherein the fixture support first channel consists of a generally "U" shaped slot directed inwardly from the second edge of the base rail.

3. The illuminable graphic support assembly as recited in claim 1, wherein the fixture support second channel consists of a generally "T" shaped slot.

4. The illuminable graphic support assembly as recited in claim 1, wherein the fixture support first channel and the fixture support second channel share a common web member therebetween.

5. The illuminable graphic support assembly as recited in claim 1, wherein the elongated base rail has an elongated flange for support of the illuminable panel thereon.

6. The illuminable graphic support assembly as recited in claim 1, wherein the fixture support first channel and the fixture support second channel are parallel to one another around the entire support assembly.

7. The illuminable graphic support assembly as recited in claim 1, wherein the fixture support first channel is partially defined by an "L" shaped corner member.

8. The illuminable graphic support assembly as recited in claim 1, wherein the fixture support second channel is defined by a pair of parallel flanges and an elongated common web member.

9. An elongated illuminable graphic support assembly, for biasing supporting a planar graphic by a biased cover rain, in a crowded space, comprising: an elongated base rail having an elongated support flange for supporting an edge of a graphic, the elongated base rail having an upper "J" shaped edge in planar alignment with the elongated support flange, the "J"-shaped flange hingedly capturing the biased cover rail, which cover rail is frictionally biased by engagement with a wavy, elongated biasing member, the wavy, elongated biasing member having a series of spaced apart ridges arranged transversely across the midpoint of the crests along the length thereof; and an elongated support flange for supporting an illuminable panel in close spaced apart juxtaposition with the planar graphic, and wherein the base rail has at least two differently directed support receiving channels comprising a downwardly directed hang bracket first channel, and a headed-fixture-support-receiving second channel for slidable receipt of a head-bearing support member therein.

10. The elongated illuminable graphic support assembly as recited in claim 9, wherein the two differently directed support receiving channels have a common base rail web disposed therebetween.

11. An illuminable frame graphic support assembly, for biasedly supporting a planar graphic by biased cover rail, the graphic support assembly comprising: an elongated base rail having an elongated support flange for supporting an edge of a graphic, the elongated base rail having an upper "J" shaped edge in planar alignment with the elongated support flange, which the "J"-shaped flange hingedly engages the biased cover rail, which cover rail is biased by a wavy, elongated biasing member, the wavy, elongated biasing member having a series of spaced apart ridges arranged transversely across the midpoint of the crests along the length thereof; and an elongated support flange for supporting an illuminable panel in close spaced apart juxtaposition with the planar graphic, and wherein the base rail has at least two differently directed support receiving channels comprising a downwardly-directed hang-bracket first channel to enable a wall support member to support the graphic support assembly from a first direction, and a headed-fixture-support-receiving second channel for slidable receipt-of a head-bearing support member therein for support of the graphic support assembly from a second direction.

12. The illuminable frame graphic support assembly, for supporting a planar graphic as recited in claim 11, wherein the downwardly directed hang bracket first channel is arranged to support the graphic support assembly from a vertical directed support member, and the headed-fixture support receiving second channel is arranged to support the graphic support assembly from a horizontally directed support member.

* * * * *